US005819451A

United States Patent [19]

Khon

[11] Patent Number: 5,819,451

[45] Date of Patent: Oct. 13, 1998

[54] ELECTRONIC BOOKMARK FOR COPY HOLDER

[76] Inventor: Trinh Cam Khon, 1739 Aprilsong Ct., San Jose, Calif. 95131

[21] Appl. No.: 802,017

[22] Filed: Feb. 18, 1997

[51] Int. Cl.[6] ..... B41J 11/38

[52] U.S. Cl. ..... 40/352; 40/442; 116/235; 116/240

[58] Field of Search ..... 40/442, 352; 116/240, 116/235

[56] References Cited

U.S. PATENT DOCUMENTS

| | | | |
|---|---|---|---|
| D. 299,931 | 2/1989 | Mauro | D19/91 |
| 1,073,939 | 9/1913 | Spedden | 116/240 |
| 3,019,424 | 1/1962 | Goldwater et al. | 40/352 |
| 4,302,192 | 11/1981 | Hamburger | 116/240 |
| 4,385,461 | 5/1983 | Wingfield | 40/352 |
| 5,025,353 | 6/1991 | Menaged | 362/98 |
| 5,081,948 | 1/1992 | Walsh | 116/240 |
| 5,407,357 | 4/1995 | Cutler | 434/335 |

*Primary Examiner*—William Stryjewski
*Attorney, Agent, or Firm*—Jeffrey P. Aiello Aiello Patent Prosecution

[57] ABSTRACT

An electronic bookmark for a copy holder that aids a user's ability to ascertain viewed text on paper retained by the copy holder is provided. The invented copy holder includes vertically adjustable indicating device that directs the user's attention to text adjacent without the use of a guide or illumination of the paper, so that text is not obscured or distorted. The copy holder comprises a backboard for retaining paper thereon and a plate rotatably coupled thereto. The plate has a bottom surface configured to releasably couple the plate to the backboard without interfering with paper interposed therebetween. The indicating device comprises a display that extends along a top surface of the plate. The display preferably comprises an array of electrodes, such as a liquid crystal display, light emitting diodes, or signal lamps, with desired segments of an array activated for directing a users attention to a selected portion of text on the document. Control device for activating desired segments of the array are coupled to the display. The control device enables the user to scroll the indicating device along the display for directing their attention to any desired portion of text. Since text is not obscured by the invention, the user can view text without any distractions caused by the indicating device. The invented copy holder has dimensions equivalent to non-electronically enhanced copy holders.

24 Claims, 3 Drawing Sheets

ELECTRONIC BOOKMARK FOR COPY HOLDER

BACKGROUND OF THE INVENTION

1. Field of the Invention

The present invention relates generally to copy holders, and more particularly, to an electronic bookmark for a copy holder.

2. Description of Related Art

A number of different devices in the prior art have been provided for holding paper for viewing. Most notably, there are several known reading stands and copy holders, which are useful in applications such as typing and lectures. Copy holders typically comprise a flat backboard for flatly retaining the paper thereon and a support for holding the backboard at an angle to the viewer. A tray or shelf is usually provided along a bottom edge of the backboard to prevent paper retained on the backboard from sliding off the copy holder.

A known disadvantage of using prior art copy holders, is that while performing tasks, such as typing or looking at an audience for example, a user typically looks directly at a document retained on the copy holder to view a portion of text. The user then looks away from the copy holder to perform the task, such as typing the or speaking to an audience, then looks back at the document. However, it frequently takes moments and sometimes several seconds for the user to again find the last portion of text viewed before continuing to the next succeeding portion text. This can be a substantial hindrance to a speaker when talking to an audience, and can substantially slow the speed of the typist.

A number of devices in the prior art have attempted to aid the user's ability to ascertain the text that they were previously viewing. One well known device comprises a guide that is slidably secured to the backboard. The guide may be translucent for viewing text directly beneath the guide, or opaque for directing the user's eyes either above or below the guide. A disadvantage of translucent guides is that they often distort text beneath the guide viewed by the user, which may be distracting to the user. A disadvantage of opaque guides is that they obscure text beneath the guide which may also be distracting to the user.

One prior art copy holder that attempts to aid the user's ability to ascertain viewed text is disclosed in U.S. Pat. No. 4,385,461, to Wingfield, which is directed to a sequentially highlighting copy holder. The disclosed copy holder includes a plurality of horizontally positioned lights, such as florescent light bulbs, that are located behind a translucent screen. The lights are sequentially illuminated for highlighting text on a page placed on the holder.

A disadvantage of the disclosed copy holder is that it is substantially cumbersome, comprising complex electronic circuitry, a plurality of florescent light bulbs, and has a rather large body for housing the light bulbs and circuitry. Another disadvantage of the disclosed copy holder, is that if more or lights goes out, the lights will not sequentially illuminate, as desired by the user.

A further disadvantage of the disclosed copy holder, as well as other devices in the prior art, is that it is somewhat difficult to read text on a front side of the paper, when text is printed on both sides thereof is illuminated. Particularly, since the paper is illuminated from the back side, text on the back side is visible through the front side of the paper, causing substantial difficulty for the reader to ascertain the desired text.

U.S. Pat. No. 5,025,353, to Menaged, is directed to an adjustable reading stand and light assembly. The disclosed reading stand includes a copy holder portion and a selectively adjustable light assembly. The adjustable light assembly facilitates placement of the light in an efficient illuminating position relative to a book or copy paper retained on the stand. A disadvantage of the disclosed reading stand, is that the light does not directly illuminate a specific portion of the page for directing the reader's eyes toward the illuminated portion. Thus, the disclosed stand does not sufficiently aid the user's ability to ascertain the text that they were previously viewing.

DES. U.S. Pat. No. 299,931, to Mauro, discloses a motorized copy holder and line scanner. The disclosed copy holder appears to include an electronically controlled guide that slides vertically along the backboard thereof. A control button is apparently provided for activating the guide.

U.S. Pat. No. 5,407,357, to Cutler, is directed to an electronic testing device for use with educational books. The disclosed device is affixed to the back cover of a book. The device includes an input section, a logic section for comparing the selected answer with correct answers programmed into memory, and an output section for providing immediate and enjoyable audio-visual feedback to the user. The device may either be permanently affixed or removably affixed to a desired book. The device includes a keypad and an LCD display screen. The device may also include data transfer means for transferring data between like devices.

There, therefore exists a need for a copy holder that aids a user's ability to ascertain viewed text for quickly finding the next succeeding portion text and which does not obscure or distort text on a document retained thereby.

OBJECTS OF THE INVENTION

It is therefore an of the present invention to provide an electronic bookmark for a copy holder that aids a user's ability to ascertain viewed text on a document retained on the bookmark for quickly locating a succeeding portion text;

It is another object of the present invention to provide an electronic bookmark for a copy holder that includes indicating means that aids a user's ability to ascertain viewed text and which does not obscure or distort any portion of text on the document;

It is a further object of the present invention to provide an electronic bookmark for a copy holder that includes indicating means that direct the user's attention to a portion of text ranging from approximately a single line of text on a document, to approximately the length of the document;

It is a still further object of the present invention to provide an electronic bookmark for a copy holder that aids a user's ability to ascertain viewed text on the document retained on the bookmark which does not illuminate the document from its back side;

It is another object of the present invention to provide an electronic bookmark for a copy holder that includes means for securing a document retained on a backboard of the copy holder to the backboard; and It is another object of the present invention to provide an electronic bookmark for a copy holder that comprises a portable and compact form.

SUMMARY OF THE INVENTION

These and other objects and advantages of the present invention are achieved by providing an electronic bookmark for a copy holder that aids a user's ability to ascertain viewed text on a document retained on the copy holder. The invented copy holder is provided with indicating means that direct the user's attention to text indicated thereby. The indicating means enables the user view a selected portion of text, look away from the copy holder to perform a desired task, such as typing or speaking, then return to viewing the document and quickly find the viewed portion of text indicated by the indicating means, and continue to the next succeeding portion of text. Thus, the users attention is directed to the desired portion of text without the use of a guide or illumination of the document, so that text to be viewed or other text on the document is not obscured or distorted by the indicating means.

The indicating means are vertically adjustable along the length of the book mark for directing the user's attention to selected portions of text, and in a sequential manner for example, so that succeeding portions of text can be viewed in a somewhat continuous, sequential fashion if desired. The indicating means substantially enhances the speed with which a typist types, or the flow of a speech delivered by a speaker, since the user does not spend time searching for desired text and the text is not distorted or obscured by the indicating means.

In the preferred embodiment of the present invention, the copy holder comprises a flat backboard for retaining paper thereon and an adjustable support means for adjusting the angle of the backboard relative to the viewer. A tray or shelf may be optionally provided along a bottom edge of the backboard to prevent paper retained on the backboard from sliding off the backboard and for placement of peripheral articles such as pens and pencils. The invented copy holder is preferably configured for desktop use, but may alternately be provided in a lectern or podium type configuration, for example. A sleeve for retaining additional documents or paper may be affixed to the backboard for access to the paper by the user.

A book mark assembly is coupled to the backboard. Preferably, a plate is rotatably coupled to the backboard to enable one or more sheets of paper to be interposed between the backboard and plate, for retaining the paper therebetween. The plate is configured with means for releasably coupling the plate to the backboard for positively securing paper to the copy holder. The releasable coupling causes the plate to exert sufficient pressure on the backboard to securely retain paper therebetween, without interference from additional retaining means, such as clamps or clips for example.

In the preferred embodiment, the indicating means are provided on a top surface of the plate, with the plate dimensioned to extend slightly into the margin of the paper, so that the indicating means does not obscure any text on the paper retained between the plate and backboard. The book mark assembly includes an elongated display extending along the plate and driver circuitry for controlling the display. The display preferably comprises a known electronic display means, such as a liquid crystal display (LCD) having an array of display electrodes, an array of light emitting diodes (LED), or an array of known signal lamps, with activated segments of the array comprising the indicating means.

An activated segment ranges in length from approximately a single line of text, to approximately the length of the document, but preferably is approximately the length of a paragraph of text. The selected indicting means may be continuously displayed or may be cyclically pulsed, so that the segment flashes on and off for directing the users attention to text adjacent to the activated segment.

Control means for activating the selected segment of electrodes are coupled to the display. The control means may comprise one or more momentary push button switches that are depressed to select the segment to be activated. Additionally, foot actuated remote control means may be provided for selecting the desired indicating means. The remote control means enables the users hands remain free for performing peripheral tasks, such as typing for example.

In use, the plate is rotated away from the backboard and a document is placed between the backboard and plate. The plate is then rotated toward the backboard until it is coupled to the magnet. The magnetic force between the magnet and plate, causes the plate to exert sufficient pressure on paper for retaining the paper. The user actuates the control means to scroll the indicating means along the display. The user can scroll the indicating means for directing their attention to different portions of text adjacent to the displayed electrodes. The book mark assembly is compact so that the invented electronic copy holder is portable, with dimensions equivalent to non-electronically enhanced copy holders.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes presently contemplated by the inventor of carrying out his invention. Various modifications, however, will remain readily apparent to those skilled in the art, since the generic principles of the present invention have been defined herein.

Figure 1:
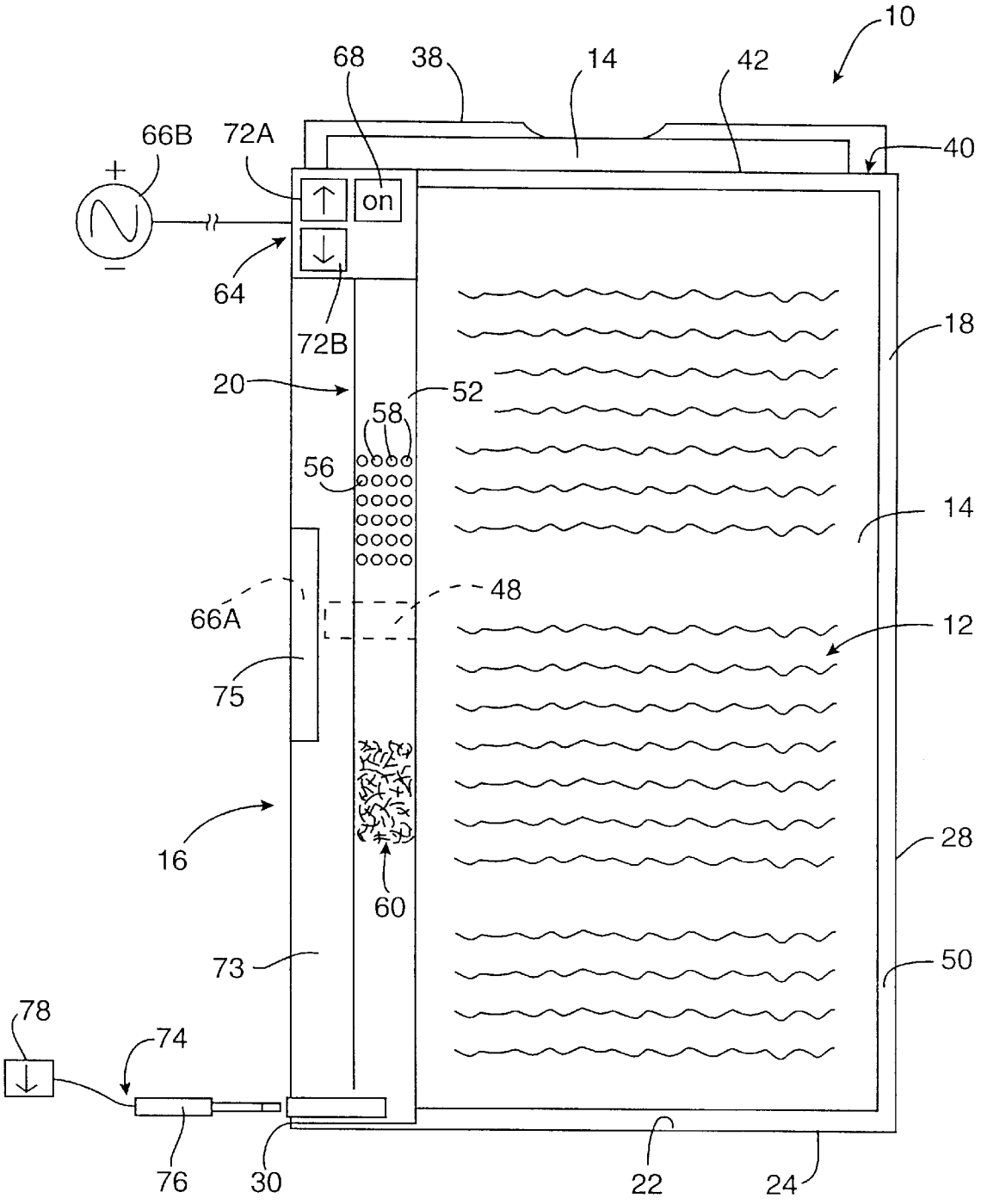
FIG. 1 is a schematic representation of an electronic bookmark for a copy holder of the preferred embodiment of the present invention.
Figure 2B:
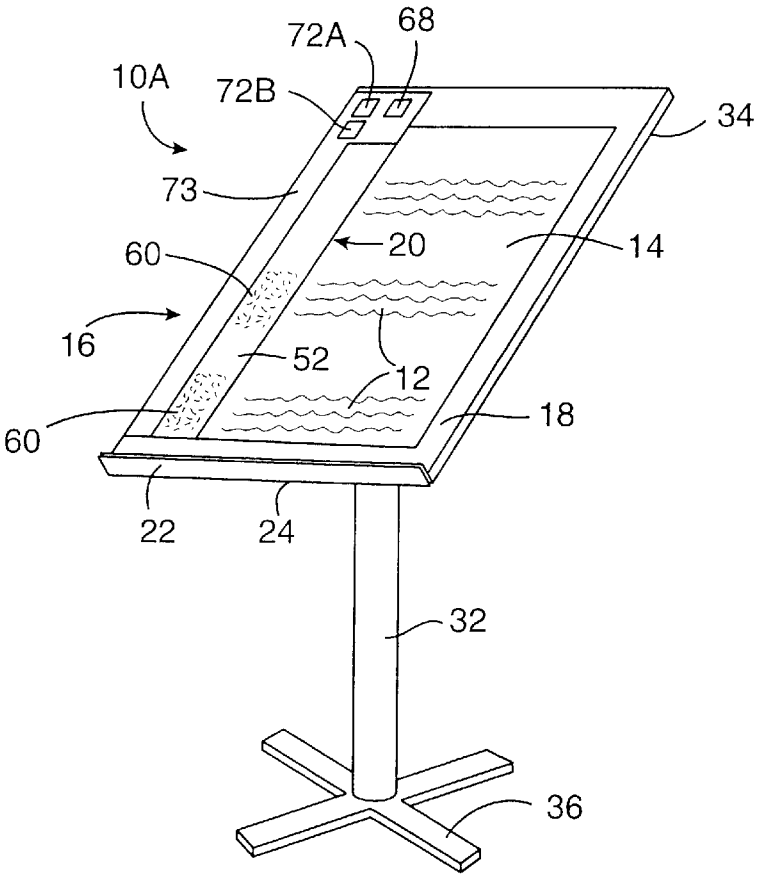
FIG. 2B is a schematic perspective view of the copy holder of the present invention in a lectern configuration.
Figure 2A:
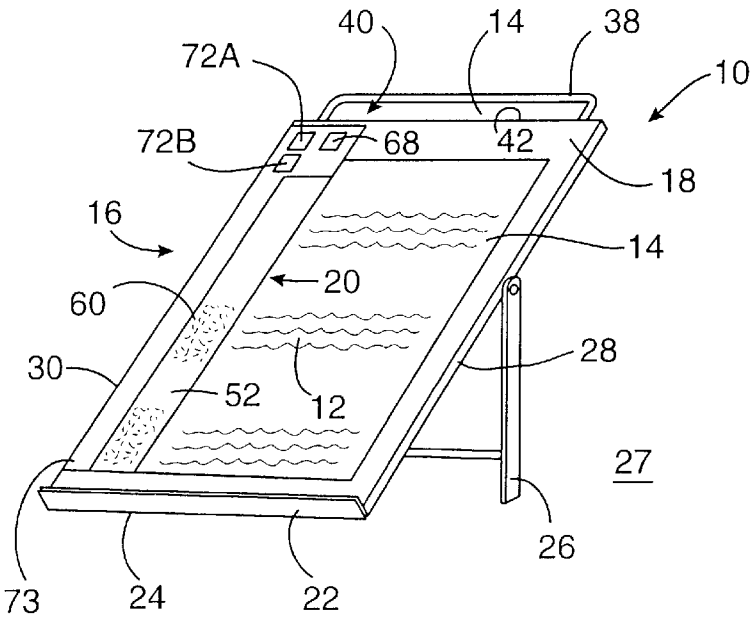
FIG. 2A is a schematic perspective view of the copy holder of the present invention in a desktop configuration.
Figure 5:
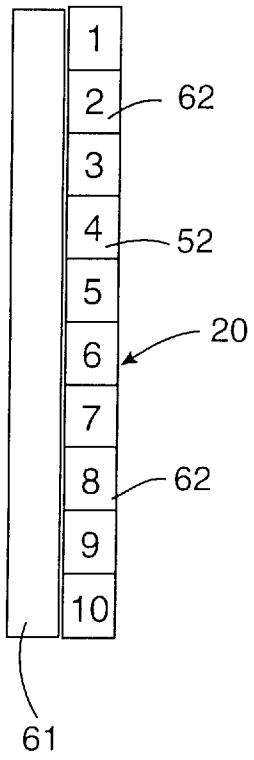
FIG. 5 is a schematic representation of a display of the present invention.

Referring now to FIG. 1 and FIGS. 2A–2B of the drawings, there is shown, generally at 10, a preferred embodiment of an electronic bookmark for a copy holder constructed according to the principles of the present invention. The invented copy holder 10 aids a user's ability to ascertain viewed text or graphics 12 on a document or paper 14 retained by the copy holder 10. The invented copy holder 10 comprises a bookmark assembly 16 coupled to a backboard 18. The bookmark assembly 16 is provided with a display assembly 20 that includes indicating means (thoroughly discussed hereinafter) for directing a user's attention directly to text 12 indicated thereby. The indicating means enables the user view a selected portion of text 12, look away from the copy holder 10 to perform a desired task, such as typing or speaking, then return to viewing the document 14 and quickly find the viewed portion of text 12, indicated by the indicating means, and continue to the next succeeding portion of text. Thus, the users attention is directed to the desired portion of text 12 without the use of a guide or illumination of the document 14, so that text 12 to be viewed or other text 12 on the document 14 is not obscured or distorted by the present invention 10.

The indicating means are vertically adjustable along the copy holder 10 for directing the user's attention to selected portions of text 12, and in a sequential manner for example, so that succeeding portions of text 12 can be viewed in a somewhat continuous, sequential fashion. The indicating means substantially enhances the speed with which a typist types, or the flow of a speech delivered by a speaker, since the user does not spend time searching for desired text and the text is not distorted or obscured by the indicating means.

In the preferred embodiment of the present invention, the copy holder 10 comprises the backboard 18 which is substantially planar for retaining the document or paper 14 thereon. The backboard 18 may be configured to any suitable dimensions, such as for accommodating well known letter, legal, or other known paper or document sizes. A tray or shelf 22 optionally may be provided along a bottom edge 24 of the backboard 18 to prevent paper 14 retained thereon from sliding off the backboard 18 and for placement of peripheral articles such as pens and pencils (not shown). The invented copy holder 10 is preferably configured for desktop use, but may alternately be provided in a lectern or podium type configuration 10A, for example.

In the desktop configuration 10, the copy holder is configured with a support bracket 26 for supporting the backboard 18 on a desktop 27 at a substantially obtuse angle to the user. The support bracket 26 is rotatably secured to side edges 28, 30 of the backboard 18 for adjusting the angle of the copy holder 10 to the user. When provided with the lectern configuration 10A, a support post 32 is affixed to a back surface 34 of the backboard 18. The support post 32 is affixed to the backboard 18 at an obtuse angle for ease of viewing documents 14 on the backboard 18. Additionally, a stand 36 is secured to the post 32 for supporting the lectern 10A.

A sleeve member 38 may be coupled to the back surface 34 of the backboard 18. The sleeve 38 is configured with an aperture 40 adjacent to a top edge 42 of the backboard 18. The sleeve 38 is configured to retain a multiplicity of papers 14 in addition to any papers 14 retained on the backboard 18. In the present invention, the backboard 18, sleeve 38, and support bracket 26 preferably comprise a suitable light rigid material, such as a suitable known polymeric material that is fabricated using known methods.

Referring now to FIGS. 1–4 of the drawings, the book mark assembly 16 includes the display assembly 20 which is mounted on an elongated mounting plate 44 coupled to one of the side edges 28, 30 of the backboard 18. For example, a hinge means 46 is affixed to the left side edge 30 and to the plate 44 for rotatably coupling the plate 44 the backboard 18. The plate 44 is rotatably coupled to the backboard 18 to enable one or more sheets of paper 14 to be interposed between the backboard 18 and plate 44, for retaining the paper 14 therebetween. Additionally, rotatably coupling the plate 44 to the backboard 18 enables paper 14 to be inserted between, or removed from the plate 44 and backboard 18, without interference from additional retaining means, such as clamps or clips for example. The plate 44 preferably comprises a metal alloy, suitable for mounting electronic components thereon and which is magnetically attracted. The plate 44 is somewhat narrow to prevent any text 12, on paper 14 having a standard margin, from being obscured thereby.

Means are provided for releasably coupling the plate 44 to the backboard 18 for positively securing paper 14 to the backboard 18. In the preferred embodiment, the releasable coupling means comprises a magnet 48 that is embedded in a front surface 50 of the backboard 18 adjacent to the left side edge 30 thereof. The force that the magnet 48 exerts on the plate 44, draws the plate 44 against the backboard 18 for releasably coupling the plate 44 thereto. The magnet 48 causes the plate 44 to exert sufficient pressure on the backboard 18 to securely retain paper 44 therebetween.

Referring now to FIGS. 1–5 of the drawings, the display assembly 20 includes a display 52 extending along the length of the plate 44 and affixed to a top surface 54 thereof. In the present invention, the display 52 may comprise any suitable known electronic display means, such as a liquid crystal display (LCD) having an array of display electrodes, an array of light emitting diodes (LED), or an array of known signal lamps. In the preferred embodiment of the copy holder 10 of the present invention, the display 52 comprises a liquid crystal display (LCD) having an array 56 of display electrodes 58 extending the length thereof. The electrodes 58 may comprise any known configuration and may be situated along the length of the display 52 in any desired pattern that is capable of directing the user's attention to adjacent text 12. Desired segments 60 of display electrodes 58, which are analogous to an array of LEDs 58 or signal lamps 58, of the array 56 are activated for directing the users attention to portion of text 12 on the document 14 adjacent to the activated segment 60. A counter circuit 61, such as a known digital counter circuit, may additionally be provided for incrementing the activated segment 60. In the preferred embodiment, an activated segment 60 may range in length from approximately a single line of text 12 to approximately the length of the document 14. However, the length of an activated segment 60 is preferably approximately the length of a paragraph of text 12.

Referring again to FIGS. 1–4, control circuitry 64 is provided for controlling the activation of desired segments 60 of the array 56. The control circuitry 64 includes a suitable power source 66 for supplying power to the display 52. The power source may comprise a known low voltage direct current (DC) battery 66A, such as a pair of well known AAA size batteries, that may be retained in a handle member 75 coupled to the plate 44, or an external power source, such as a known 120 volt alternating current (AC) utility power source 66B, for example.

A momentary activation switch 68, such as a push-button switch is coupled to the power source 66 for activating and deactivating the display 52. A known driver circuit 70 is coupled to the activation switch 68 for activation thereof. The driver circuit 70 may comprise any known assemblage of electronic components or digital logic circuitry, that is capable of driving the electrodes 58 of the display 52 as discussed above. In the preferred embodiment, the circuit 70 is fabricated on a printed circuit board as is known in the art.

The control circuitry 64 additionally comprises at least one momentary directional push-button switch 72 coupled to the driver circuit 70. In the preferred embodiment, a first push-button switch 72A is provided for scrolling the activated segment 60 in an upward direction, from the bottom edge 22 of the backboard 18 toward the top edge 42, and a second push-button switch 72B is provided for scrolling the activated segment 60 in a downward direction, from the top edge 42 of the backboard 18 toward the bottom edge 22. The directional push-button switches 72 are preferably positioned proximal to the momentary activation switch 68 for ease of controlling the circuitry 64. The directional push-button switches 72 are repeatedly depressed to selectively activate desired segments 60 of the array 52 along the length of the display 52 for displaying the desired segments 60. The directional push-button switches 72, in combination with the driver circuit 70, control the activation of desired segments 60 of the array 56 responsive to activation thereof, such that adjacent segments 60 of the array 56 can be sequentially activated and distal segments 60 of the array 56 can be sequentially activated for scrolling the activated segments 60 along the display 52, and for nonsequentially scrolling the activated segments 60 along the display 52.

Further, a cover member 73 may be affixed to the book mark assembly 16 to cover the is circuit 70 and to add to the aesthetics thereof. The handle 75, or other appropriate means may be provided to aid with rotating the book mark assembly 16.

Figure 4:
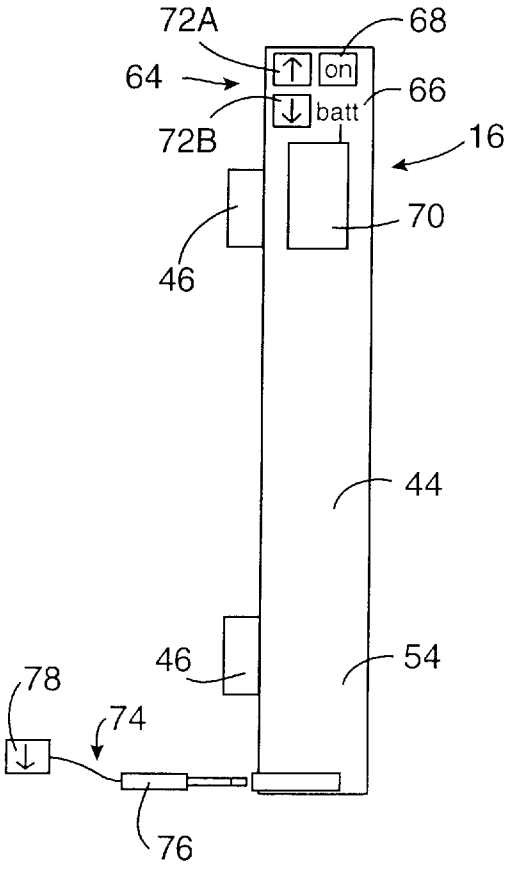
FIG. 4 is a schematic representation of a mounting plate for the bookmark assembly of the present invention.
Figure 3:
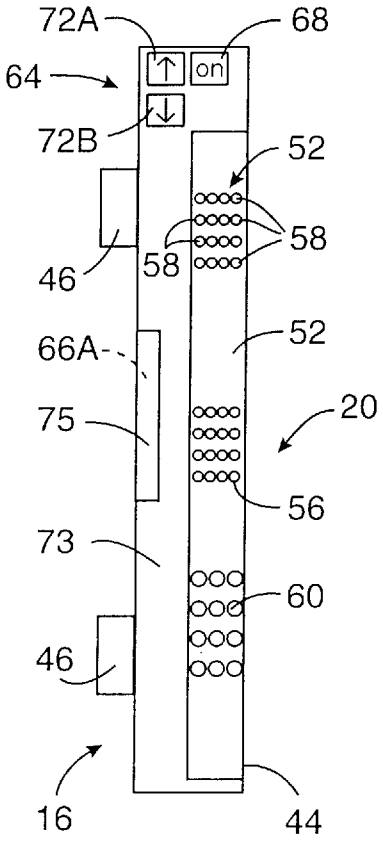
FIG. 3 is a schematic representation of an electronic bookmark assembly of the preferred embodiment.

As shown in FIG. 1 and FIG. 4, a foot actuated remote control means, such as a foot pedal 74 may be provided for selecting the desired segment 60 to be activated. The foot pedal 74 is connected to the control circuitry 64 via appropriate connecting means 76 for controlling activation of the desired segments 60 of the array 56 as discussed above. The foot pedal 74 is provided with buttons 78 for controlling activation of the desired segments 60, while the users hands remain free for performing peripheral tasks, such as typing for example.

In use, the plate 44 is rotated away from the backboard 18 and paper 14, or a desired document 14, is placed between the backboard 18 and plate 44, and adjacent to the left side edge 30 of the backboard 18. The plate 44 is then rotated toward the backboard 18 until it is coupled to the magnet 48. The plate 44 is sufficiently narrow to prevent any text 12, on paper 14 having a standard margin, from being obscured thereby. The magnetic force between the magnet 48 and plate 44, causes the plate 44 to exert sufficient pressure on the document 14 for retaining the document 14. The control circuitry 64 is then initialized for activating the display 52. The user then actuates the directional push-button switches 72 to scroll the activated segment 60 along the display 52 toward the bottom edge 22 of the backboard 18. The user can scroll the activated segment 60, to any desired location on the display 52 for directing their attention to text 12 adjacent to the displayed segment of electrodes 60.

The present invention enables the user to scroll the activated segment 60 along the display 52, in either direction, for directing their attention to any desired portion of text 12 on document 14 retained by the invented copy holder 10. Additionally, since text 12 is not obscured by the invented copy holder 10 in any way, such as being illuminated from behind or distorted by a translucent guide, the user can view the text 12 without any distractions and quickly perform any desired tasks. Further, since the display assembly 20 is contained on the plate 44, the invented electronic copy holder 10 has portable and compact dimensions equivalent to non-electronically enhanced copy holders.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for indicating selected portions of text on a document located adjacent thereto, the device comprising:

means for supporting the document adjacent to the device;

power source means;

display means coupled to the power source and extending along a length of the support means and adjacent to the document, the display means including indicating means for indicating a selected portion of text, the indicating means selectively activated to indicate different selected portions of text on the document; and control means for activating different desired indicating means along the display means.

2. The device of claim 1 wherein the display means comprises a display having an array of display electrodes extending the length thereof, with desired segments of the array activated for directing a users attention to a selected portion of text on the document.

3. The device of claim 2 wherein the control means includes control circuitry for selectively activating desired segments of the array along the length of the display means, the control means controlling the activation of desired segments of the array, such that adjacent segments of the array can be activated and distal segments of the array can be activated for scrolling the activated segments along the display means.

4. The device of claim 3 wherein the control means further comprises foot actuated remotely located control means for enabling activation of the control means without a users hands.

5. An electronic bookmark for a copy holder comprising:

a backboard for supporting a document;

power source means; and a display assembly, the display assembly including, retaining means coupled to the backboard and extending along a length thereof, the retaining means dimensioned to retain the document against the backboard and to extend into a margin of the document, display means coupled to the power source and extending along the length of the retaining means and adjacent to the margin of the document, the display means including indicating means for indicating a selected portion of text, and control means for selectively activating the indicating means to indicate different selected portions of text on the document, the control means controlling the activation of different desired indicating means along the display means to direct a users attention to a desired portion of text on the document.

6. The copy holder of claim 5 wherein the display means further comprises an electronic display means selected from the group consisting of a liquid crystal display having an array of display electrodes, an array of light emitting diodes, and an array of signal lamps, with desired segments of an array activated for directing a users attention to a selected portion of text on the document.

7. The copy holder of claim 6 wherein the control means further comprises at least one momentary push-button switch for selectively activating desired segments of the array along the length of the display means, the push-button switch controlling the activation of desired segments of the array, such that adjacent segments of the array can be activated and distal segments of the array can be activated for sequentially scrolling the activated segments along the display means and for nonsequentially scrolling the activated segments along the display means.

8. The copy holder of claim 7 wherein desired segments of the display electrode array are activated to direct the users attention to a selected portion of text on the document adjacent to the activated segment, an activated segment ranging in length from approximately a single line of text to approximately the length of the document.

9. The copy holder of claim 8 wherein the control means transmits a selected one of a continuous activation signal to the selected segment of electrodes for continuously activating the electrodes and a cyclical pulse signal to the electrodes for cyclically pulsing the segment for intermittently displaying the electrodes to direct the users attention to text adjacent thereto.

10. The copy holder of claim 9 wherein the control means further comprises foot actuated remotely located control means for enabling activation of the control means without a users hands.

11. The copy holder of claim 5 wherein the power source means comprises a selected one of a low voltage battery that is retained on the plate and an external utility power source.

12. The copy holder of claim 5 wherein the retaining means is magnetically coupled to the backboard for securely retaining the document therebetween.

13. An electronic copy holder comprising:

a planar backboard for supporting a document, the backboard having support means secured to a back surface thereof and a front surface;

a display assembly, the display assembly including, an elongated plate member rotatably coupled to a side edge of the backboard and extending along the length thereof, the plate dimensioned to retain the document against the backboard and to extend into a margin of the document without obscuring text on the document, the plate having a top surface and a bottom surface, means for detachably coupling the plate to the backboard, the coupling means detachably coupling the bottom surface of the plate to the front surface of the backboard for positively retaining the document therebetween, and display means extending along the length of the plate and affixed to the top surface thereof, the display means selected from the group consisting of a liquid crystal display having an array of display electrodes, an array of light emitting diodes, and an array of signal lamps, with desired segments of an array activated for directing a users attention to a selected portion of text on the document; and control means for selecting the segments of the array to be activated, the control means including, a power source, switch means coupled to the power source for activating and deactivating the display means, and directional control means for selectively activating desired segments of the array along the length of the display means, the directional control means controlling the activation of desired segments of the array, such that adjacent segments of the array can be sequentially activated and distal segments of the array can be sequentially activated for scrolling the activated segments along the display means and for nonsequentially scrolling the activated segments along the display means.

14. The copy holder of claim 13 wherein desired segments of the display electrode array are activated to direct the users attention to a selected portion of text on the document adjacent to the activated segment, an activated segment ranging in length from approximately a single line of text to approximately the length of the document.

15. The copy holder of claim 14 wherein desired segments of the display electrode array are activated to direct the users attention to a selected portion of text on the document adjacent to the activated segment, an activated segment ranging in length from approximately a single line of text to approximately a paragraph length of text.

16. The copy holder of claim 13 wherein the control means further comprises:

the switch means comprising a momentary power push-button switch secured to the top surface of the plate and coupled to the power source for activating and deactivating the display means;

the directional control means comprising at least one momentary directional push-button switch secured to the top surface of the plate and positioned proximal to the switch means, the directional switch repeatedly depressed to selectively activate desired segments of the array along the length of the display means for displaying the indicting means; and control circuitry interposed between the momentary push-button switches and display means, the control circuitry controlling the activation of desired segments of the array responsive to activation thereof by the momentary directional push-button switch, such that adjacent segments of the array can be sequentially activated and distal segments of the array can be sequentially activated for scrolling the activated segments along the display means and for nonsequentially scrolling the activated segments along the display means.

17. The copy holder of claim 16 wherein a first momentary directional push-button switch is provided for selectively scrolling the activated segments along the display means in a first direction and a second momentary directional push-button switch is provided for selectively scrolling the activated segments along the display means in a second direction.

18. The copy holder of claim 16 wherein the control circuitry is configured to transmit a selected one of a continuous activation signal to the selected segment of electrodes for continuously activating the electrodes and a cyclical pulse signal to the electrodes for cyclically pulsing the segment for intermittently displaying the electrodes to direct the users attention to text adjacent thereto.

19. The device of claim 13 wherein the control means further comprises foot actuated remotely located control means for enabling activation of the control means without a users hands.

20. The copy holder of claim 13 wherein the power source comprises a selected one of a low voltage battery that is retained on the plate and an external utility power source.

21. The copy holder of claim 13 wherein the coupling means for detachably coupling the plate to the backboard further comprises:

the plate member comprising a magnetic metal alloy; and the backboard having a magnet embedded in the front surface adjacent to the side edge thereof such that the magnet is positioned beneath the plate when the plate is rotated parallel to the backboard, the magnetic force between the plate and magnet drawing the plate toward the magnet for magnetically coupling the plate thereto to securely retain the document therebetween.

22. The copy holder of claim 13 further comprising a sleeve member affixed to the back surface of the backboard, the sleeve member configured to a retain a plurality of sheets of paper therein adjacent to the backboard for providing facile access to the paper by the user.

23. The copy holder of claim 13 wherein the copy holder is configured to reside on a desktop and the support means secured to the back surface of the backboard are adjustable for adjusting an angle of the copy holder relative to the user.

24. The copy holder of claim 13 wherein the copy holder is configured as a lectern with a support member secured to the back surface of the backboard such that the copy holder extends at an obtuse angle relative to the user.

* * * * *